US005133693A

United States Patent [19]

Blomster

[11] Patent Number: 5,133,693

[45] Date of Patent: Jul. 28, 1992

[54] AIR SUPPLY AND EXHAUST GRILL

[75] Inventor: Ranier T. Blomster, Sarasota, Fla.

[73] Assignee: Imark, Inc., Sarasota, Fla.

[21] Appl. No.: 730,112

[22] Filed: Jul. 15, 1991

[51] Int. Cl.[5] ..... F24F 13/062

[52] U.S. Cl. ..... 454/312

[58] Field of Search ..... 454/300, 312

[56] References Cited

U.S. PATENT DOCUMENTS

| | | | |
|---|---|---|---|
| 2,125,454 | 8/1938 | Marshall | 454/300 |
| 2,958,272 | 11/1960 | Titus et al. | 454/312 |
| 3,063,356 | 11/1962 | Fitt | 454/312 |
| 3,107,597 | 10/1963 | Person | 454/312 |

*Primary Examiner*—Harold Joyce

*Attorney, Agent, or Firm*—Charles J. Prescott

[57] ABSTRACT

An air supply and exhaust grill which requires no tools or fixtures for assembly of the components thereof and which provides for convenient manual adjustment of air flow therethrough. The device is preferably circular about a longitudinal axis to facilitate connection to a round air conduit and to provide a distinctive finished appearance, and includes an outer an an inner housing each having a main tubular portion and a radially extending flange. The inner tubular member is frictionally adjustable axially within the outer housing so as to control the air gap between the two flanges. Mating notches and stop are also provided between inner and outer housings which are selectively engagable by rotation of the inner housing.

6 Claims, 3 Drawing Sheets

FIG. 2
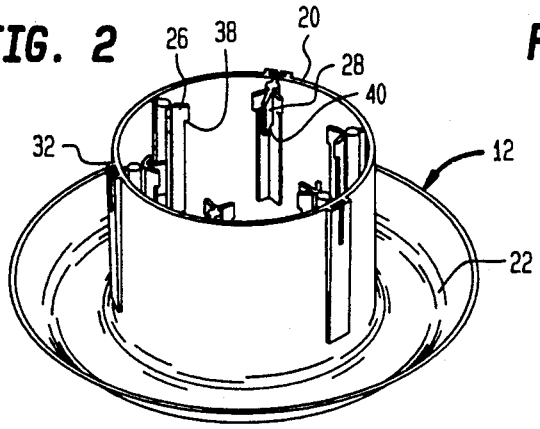
FIG. 3
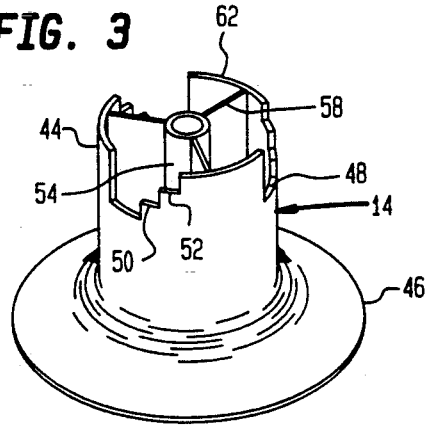
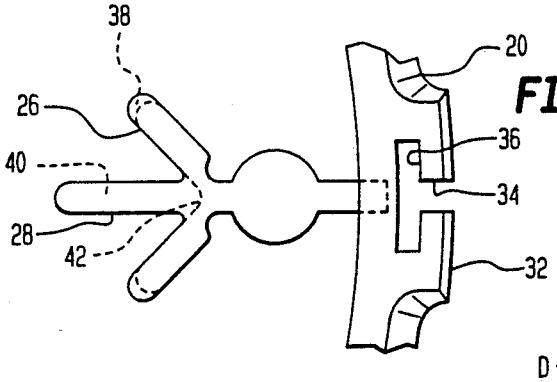
FIG. 7
FIG. 6A
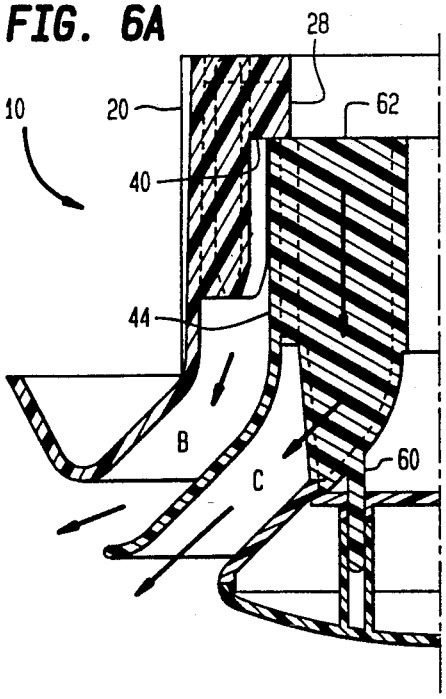
FIG. 6B
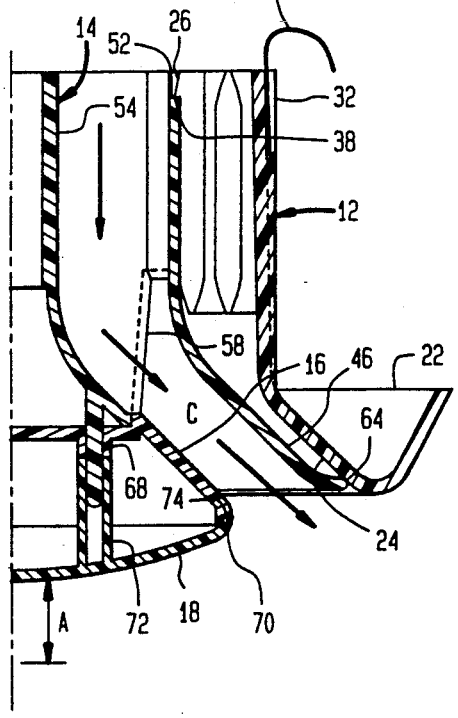

AIR SUPPLY AND EXHAUST GRILL

BACKGROUND OF THE INVENTION

This invention is generally directed to air intake and exhaust grills, and more particularly to such a unique grill which is easily assembled and adjustable.

Air intake and exhaust grills are commonly found throughout dwellings and offices for use in either air discharge into a room or for gathering return or exhaust air for removal from a room. Typically, such grills are ceiling mounted, but may also be located in a wall surface. Many of these grills are either without louvers and are therefore not adjustable or include longitudinal louvers which may be angularly reoriented to control both direction and quantity of air flow into or out of such adjustable louvered grills.

A particular installation such as found in shower rooms is that of a circular type molded of plastic material for connection by an air conduit or duct to an exhaust fan for removing humidity and odors from these areas. Applicant is aware of one such popularly-used device which includes an outer housing and an inner housing, the inner housing being held in place and made adjustable by interconnection via an axially oriented threaded shaft between the two components. However this device is both cumbersome to assemble and to adjust in use.

The present invention provides an easily assemblable air intake and exhaust grill requiring no tools or equipment for assembly of its molded components and also providing for ease of installation and ready incremental adjustment as desired by the user.

BRIEF SUMMARY OF THE INVENTION

This invention is directed to an air supply and exhaust grill which requires no tools or fixtures for assembly of the components thereof and which provides for convenient manual adjustment of air flow therethrough. The device is preferably circular about a longitudinal axis to facilitate connection to a round air conduit and to provide a distinctive finished appearance, and includes an outer and an inner housing each having a main tubular portion and a radially extending flange. The inner tubular member is frictionally adjustable axially within the outer housing so as to control the air gap between the two flanges. Mating notches and stop are also provided between inner and outer housings which are selectively engagable by rotation of the inner housing.

It is therefore an object of this invention to provide an air intake and exhaust grill which includes molded plastic components which are easily assemblable either by a manufacturer or by the end user or installer without the need of tools or fixtures.

It is another object of this invention to provide an easily adjustable air intake and exhaust grill which adjustment provides for a wide range of air flow settings.

It is yet another object of this invention to provide an air intake and exhaust grill which includes convenient means for interconnection to an air discharge or inlet conduit.

In accordance with these and other objects which will become apparent hereinafter, the instant invention will now be described with reference to the accompanying drawings.

BRIEF DESCRIPTION OF THE DRAWINGS

FIG. 2 is a perspective view of the molded outer housing of the invention.

FIG. 3 is a perspective view of the molded inner housing of the invention.

FIGS. 6A and 6B are side elevation section views bifurcated along the center line to show the invention in both its open and its closed configuration.

FIG. 7 is an enlarged view of area 7 in FIG. 4.

DETAILED DESCRIPTION OF THE INVENTION

Figure 1:
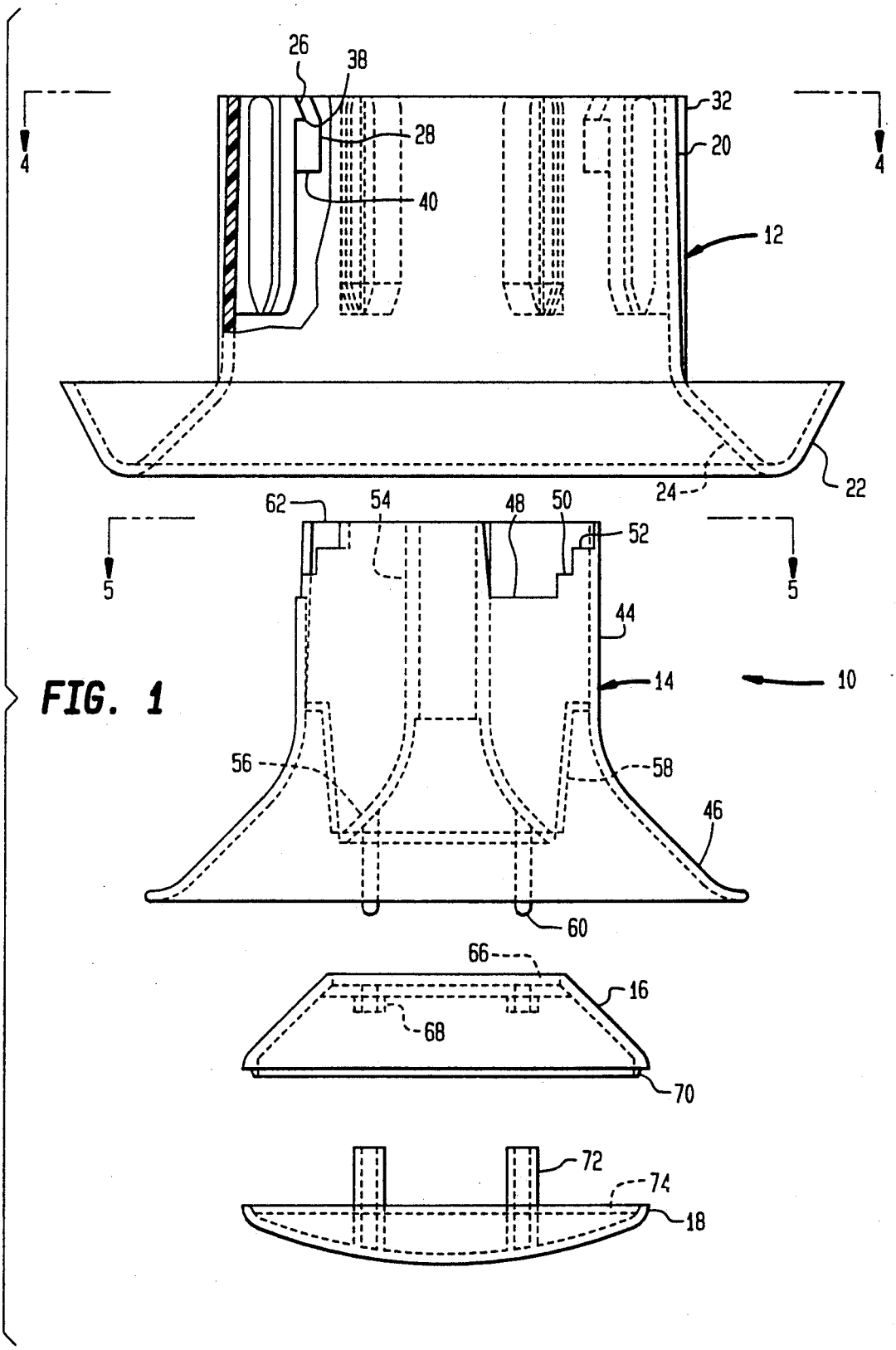
FIG. 1 is an exploded side elevation view of the invention.

Referring now to the drawings, the invention is shown generally at number 10 and includes an outer housing 12 and an inner housing 14. Cap ring 16 and cap 18 are also provided and are interconnected to inner housing 14 as will be described herebelow.

The outer housing 12 is integrally molded of plastic and includes a main cylindrical tubular member 20 and a generally U-shaped flange 22 which outwardly extends from the lower end of tubular member 20. Tubular member 20 is circular in cross section and is sized to slidably engage into an end of an air conduit or duct of an appropriate size and configuration. Flange 22 includes a generally inner truncated conical surface 24 which uniformly outwardly extends from the generally cylindrical surface of tubular member 20. Flange 22 bends back to form a margin which will mate against a wall or ceiling surface.

The inner housing 14 is also integrally molded of plastic and includes tubular member 44 which merges and outwardly extends to flange 46 so as to provide a smooth inner and outer surface for air flow thereover. The outer surface of tubular member 44 is sized to snugly fit within radius 30 shown in FIG. 4 which is defined by a plurality of pairs of opposing retaining blades 26. These retaining blades 26 are integrally molded and radially extend inwardly from the inner surface of tubular member 20, are oriented at approximately 90 degrees to one another per pair, and are positioned in pairs uniformly spaced around the inner circumference of tubular member 20.

These pairs of blades 26 are elastically deflectable, with radius 30 being slightly smaller than the diameter of tubular member 44, blades 26 outwardly deflect so as to biasingly act against the outer surface of tubular member 44 when inserted therewithin. This arrangement of blades 26 pressing against the outer surface of tubular member 44 in an even array around its circumference affords sufficient biasing means for retaining inner housing 14 in stationary axial alignment within outer housing 12 as best seen in FIG. 6. Thus, by this arrangement, the inner housing 14 may be manually moved axially with respect to the outer housing 12 back and forth in the direction of arrow A in FIG. 6.

Figure 4:
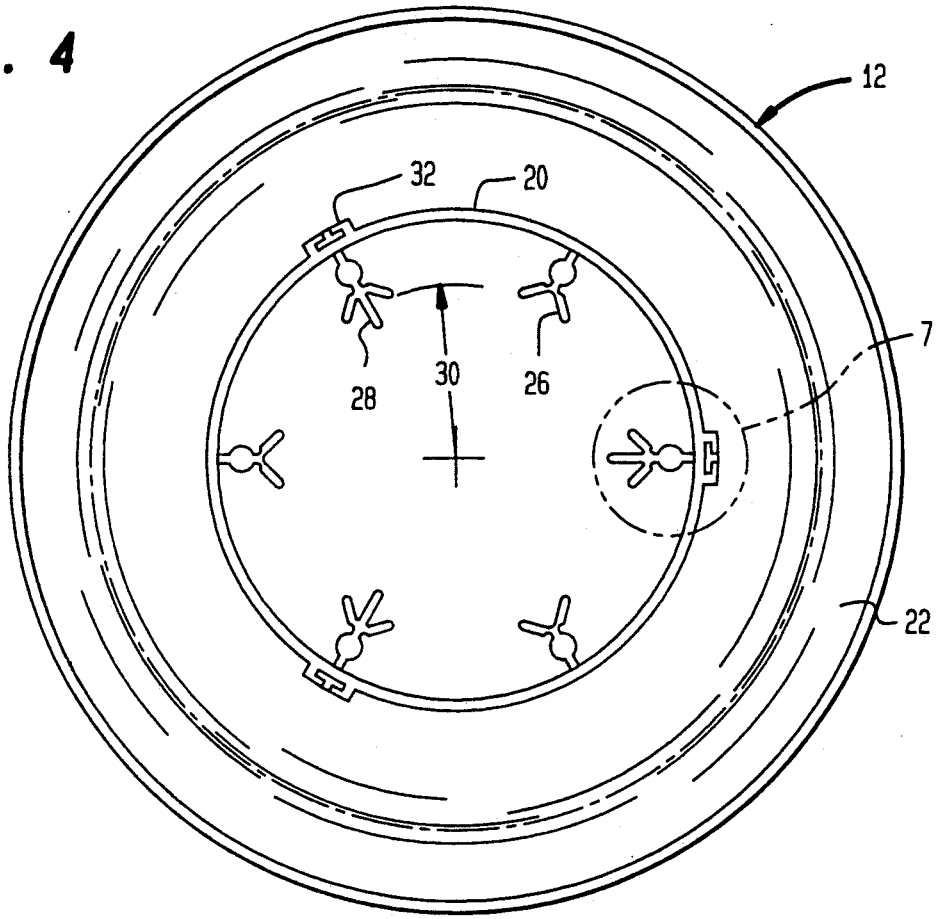
FIG. 4 is a top plan view of FIG. 2.
Figure 5:
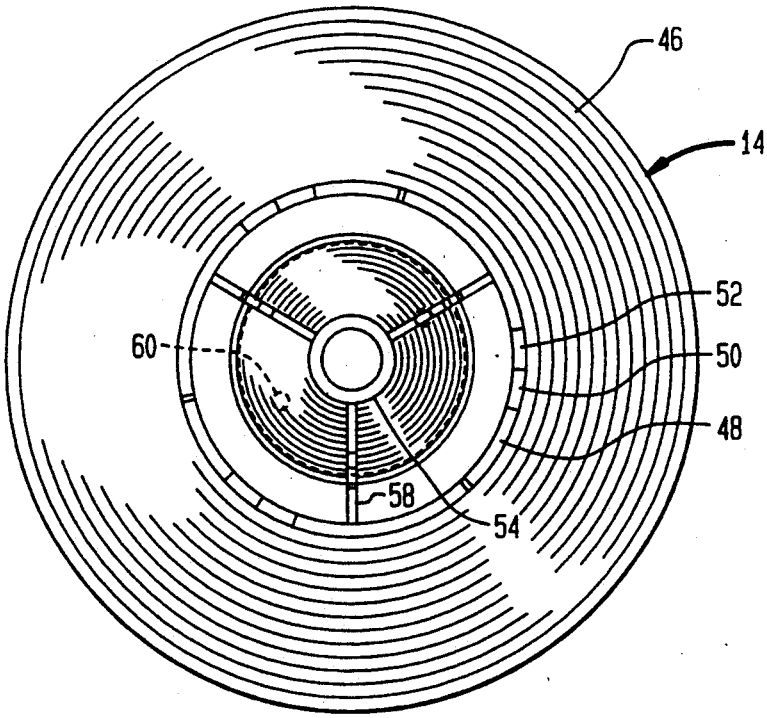
FIG. 5 is a top plant view of FIG. 3.

To facilitate axial positioning of inner housing 14 within outer housing 12, notches 48 are formed in the upper distal edge of tubular member 44 which cooperatively interengage against surface 40 of tabs or stops 28 which inwardly radially extend between blades 26 as best seen in FIG. 4, 6 and 7. These tabs 28 contact either the bottom of notch 48 or an intermediate step 50 or 52 as the inner housing 14 is slidably inserted coaxially into outer housing 12 and centered within blades 26 as previously described. Thus, by the appropriate rotational positioning of inner housing 14, tabs 28 engage against either the bottom of notch 48 or steps 50 or 52 to prevent further axial engagement of inner housing 14 into outer housing 12.

Referring particularly to FIG. 6A, that figure depicts the grill 10 in its open position, while the right hand portion of FIG. 6 depicts the grill 10 in its closed position. In its open position, the grill 10 provides two separate air passages, an outer air passage formed between tubular member 20 and 40 so that, when opened, air will flow, for example, outwardly in the direction of arrows B. An inner air passage is within the cylindrical tubular member 44 so that air will flow, for example, outwardly for discharge in the direction of arrows C.

Flange surface 24 and flange 46 are configured similarly so as to form a diagonally outwardly directed air passageway portion when separated. Inner housing 14 includes a central defusing element 54 which is centrally positioned within tubular member 44 by partitions 58. The lower flared portion 56 has a similar but smaller shape to that of flange 46 as best seen in FIG. 1 and 6. The cap ring 16 includes tubular guides 68 which slidably engage over pins 60 which downwardly extend from flared portion 56. The lower end of flared portion 56 matably engages within recess 66. A cap 18 includes upwardly extending tubular portions 72 which are sized to be forcibly urged over pins 60 and be held thusly by tight friction fit when fully engaged. Recess 74 mates with collar 70 so as to provide a tight finished appearing fit between cap ring 16 and cap 18.

The cooperative structure between flared portion 56 and cap ring 16 as seen in FIG. 6, thus forms the defusing structure which redirects air flow as, for example, outwardly in the direction of arrow C in a fixed configuration.

Referring to FIG. 6B, when inner assembly 14 is moved upwardly to its closed position, the distal margin 64 of flange 46 contacts against the inner panel 24 of flange 22 so as to block the air flow through the outer air passage. In the closed configuration, therefore, air will only flow through the inner air passage in the direction, for example, discharging in the direction of arrow C.

To facilitate interconnection of the device 10 with a conventional air conduit, referring particularly to FIG. 7, a plurality of evenly spaced clip retainers 32 integrally molded to the outer surface of tubular member 20 are also provided. Openings 34 allow for a degree of flexibility so that a spring-formed clip D as seen in FIG. 6 may be inserted into cavity 36 of clip retainer 32. Spring clip D is formed so that, when held within clip retainer 32, it will resiliently deflect so as to slide into the air duct and then act to resist removal once positioned within the air duct.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. An air supply and exhaust grill comprising:

a molded outer housing having a first tubular main portion and an enlarged first flange laterally extending from one end of said first tubular portion, said first flange structured for mounting against an interior room surface which has a prepared aperture through which said first tubular portion is fitted;

said outer housing structured for connection to an air supply or air discharge conduit at its other end;

a molded inner housing having a second tubular main portion and an enlarged second flange laterally extending from one end of said second tubular portion, the interior of said inner housing forming a first air passage;

bias means between said first and second tubular portions for retaining said second tubular portion within and in coaxial alignment with said first tubular portion and for permitting manually adjustable axial translation of said second tubular portion between an open and a closed axial position with respect to said first tubular portion;

said first and second tubular portions forming a second air passage therebetween, said second air passage closed at a first end thereof by mating contact between said first and second flanges when said second tubular portion is in its closed position, said second air passage open at said first end and extending between said first and second flanges when said second tubular portion is in its open position and said first and second flanges are spaced apart.

2. An air supply and exhaust grill as set forth in claim 1, further comprising:

notch means formed into the other end of second tubular portion which cooperatively engages against a stop means projecting radially inwardly from an interior surface of said first tubular portion for adjustably controlling axial positioning of said inner housing within said outer housing.

3. An air supply and exhaust grill as set forth in claim 2, wherein:

said notch means is selectively engagable against said stop means to control the spacing between said first and second flanges between open and closed positions by selective axial rotation of said inner housing with respect to said outer housing.

4. An air supply and exhaust grill as set forth in claim 1, wherein:

said inner housing includes an inner air diffuser within said first air passage which is generally axially coextensive with said second tubular portion, said inner air diffuser having an enlarged portion at one end which is similar in shape but smaller than said second flange;

said inner air diffuser cooperatively structured with said second flange to disperse air radially outwardly as the air discharges from therebetween.

5. An air supply and exhaust grill as set forth in claim 4, further comprising:

a cap connected to the end of said inner air diffuser enlarged portion, said cap further outwardly extending the surface of said enlarged portion to effect greater air dispersion and to serve as a hand grasping element for axial adjustment of said inner housing.

6. An air supply and exhaust grill as set forth in claim 1, further comprising:

a clip holder formed into said outer housing for receiving a retaining clip which is adapted to hold said outer housing within an end of a length of air conduit.

* * * * *